United States Patent [19]

Friederichs et al.

[11] 3,991,437

[45] Nov. 16, 1976

[54] CONCEALED HINGE FOR FURNITURE

[75] Inventors: Paul Friederichs, Vilkerath; Theodor Vitt, Porz-Eil, both of Germany

[73] Assignee: Prameta Prazisionsmetallund Kunststofferzeugnisse, Cologne, Germany

[22] Filed: Mar. 8, 1976

[21] Appl. No.: 665,112

[30] Foreign Application Priority Data

Mar. 14, 1975 Germany ..... 2511201

[52] U.S. Cl. ..... 16/139; 16/166

[51] Int. Cl.[2] ..... E05D 11/10

[58] Field of Search ..... 16/139, 135, 142, 145, 16/147, 180, 162, 163, 166, 190

[56] References Cited

UNITED STATES PATENTS

| | | | |
|---|---|---|---|
| 3,470,579 | 10/1969 | Cencioni | 16/166 |
| 3,860,995 | 1/1975 | Lautenschlaeger et al. | 16/139 |
| 3,940,828 | 3/1976 | Lautenschlaeger | 16/163 |
| 3,952,367 | 4/1976 | Wilke et al. | 16/147 |

*Primary Examiner*—G. V. Larkin

*Attorney, Agent, or Firm*—Diller, Brown, Ramik & Wight

[57] ABSTRACT

This disclosure relates to a concealed hinge for furniture doors and includes at least three hinge elements, a first element being carried by the frame, a second element being mounted at one end for sliding movement relative to the first element and being pivotally connected at an opposite end to a door, the third element being pivoted to the first element and to the second element, and latch means pivotally connected to the third element by the pivot connection between the second and third elements. The latch means is preferably spring biased toward its latched position and is preferably U-shaped as viewed in cross-section. A fourth hinge element is pivotally connected between the door and the third hinge element and the latch means latches upon the pivot between the door and fourth hinge element.

19 Claims, 10 Drawing Figures

CONCEALED HINGE FOR FURNITURE

The present invention relates to a concealed hinge for doors, particularly a furniture hinge, of the type which includes at least one hinge element affixed to a furniture frame and another generally U-shaped hinge element slidably connected at one end to the first hinge element and pivotally connected at an opposite end to an associated door. Additional hinge elements or links may be utilized to assure proper opening and closing of the door relative to the frame, and at least one of the additional hinge elements is also of a U-shaped configuration and is pivotally connected to the second hinge element. This creates a very stable arrangement which precludes the hinge from being twisted or distorted and enables the door to be swung to an angle up to 180°. Furthermore, due to this construction, the connection between the first and second hinge elements is relieved of bending forces which likewise imparts to the hinge as a whole considerable rigidity. The hinge is preferably and advantageously suitable for relatively heavy doors or door leaves.

The hinge of this invention further includes latch means pivotally connected to the third hinge element for latching or locking the door in its closed position. Preferably the latch member is spring biased toward its latched position, and a construction of the hinge is such that the hinge may be utilized with or without the latch means without any modification of the hinge. Therefore, one and the same hinge can be used as a normal (non-latching) hinge or as a latching hinge and is, thus, unnecessary to maintain an extensive and duplicate stock of hinges.

It is therefore a primary object of this invention to provide a concealed hinge for furniture doors of the type initially referred to which can, in a simple manner, be used as a normal hinge (devoid of a latch) or a spring hinge, and guarantees in the latter case a safe, resilient, snap latching for locking the door closed relative to a furniture frame.

A further object of this invention is to provide a novel hinge of the type heretofore defined which includes at least three hinge elements, a first of the hinge elements being fixed to a frame, a second of the hinge elements being slidably displaceably connected at one end to the first hinge element and pivotally connected at its opposite end to an associated door, the third hinge element being pivotally connected at one end to the first hinge element and at a medial portion to the second hinge element, and the pivot connection between the second and third hinge elements also pivotally connecting latch means thereto which is adapted to hold the door locked in its closed position relative to the frame.

Still another object of this invention is to provide a novel hinge of the type aforesaid wherein a fourth hinge element is pivotally connected to the remaining end of the third hinge element and to the door, and the latch means hooks upon or engages against the pivot means connecting the fourth hinge element to the door.

In further accordance with this invention, the latch means is of a generally C-shaped cross-sectional configuration including first and second terminal end portions, one of the end portions constituting the latching portion of the latching means, and spring means associated with the other of the terminal end portions for normally biasing the latching means toward its latching position.

A further object of this invention is to provide a novel hinge of the type heretofore set forth wherein a bushing is rotatably mounted on the pivot connection between the fourth element and the door, and though rotatable the tolerances are such that there is no play between the bushing and its associated pivot means so that there is not even the slightest possibility of movement between the door and frame in the locked position thereof.

In further accordance with this invention, the latch means is preferably pivotally connected to the third hinge element by a pivot pin passing through the latch means and having opposite ends retained in opposite legs of the third hinge element which is generally of a U-shaped configuration as viewed in transverse cross-section.

It is a further object of this invention to bias the latching means toward its latching position by either a leaf spring, a tension spring, a torsion spring, or by constructing the latch means itself, or a portion thereof from resilient material.

Yet another object of this invention is to provide a novel hinge of the type aforesaid wherein the latch means is preferably formed as a molded component of synthetic polymeric or copolymeric plastic material, and latch means may also carry a roller to reduce friction at the time of latching.

With the above and other objects in view that will hereinafter appear, the nature of the invention will be more clearly understood by reference to the following detailed description, the appended claimed subject matter, and the several views illustrated in the accompanying drawings.

Figure 1:
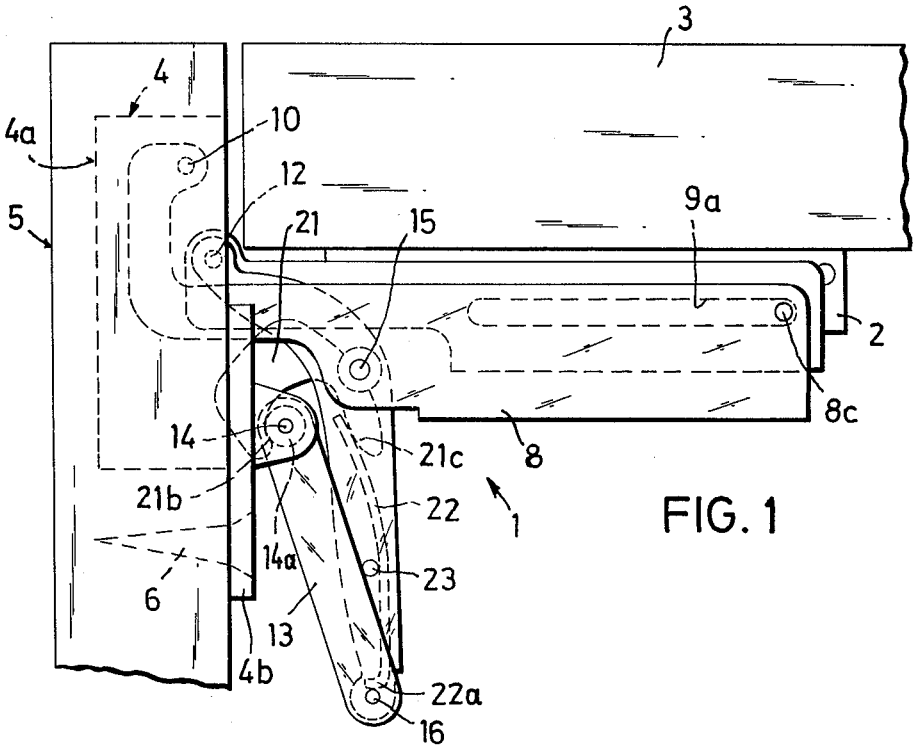
FIG. 1 is a fragmentary top plan view of a novel hinge constructed in accordance with this invention, and illustrates the closed position of a door relative to a furniture frame and a latch pivotally carried by a hinge element in latching engagement with a bushing carried by a pivot pin associated with a hinge element pivotally connected to a mounting plate of the door.
Figure 2:
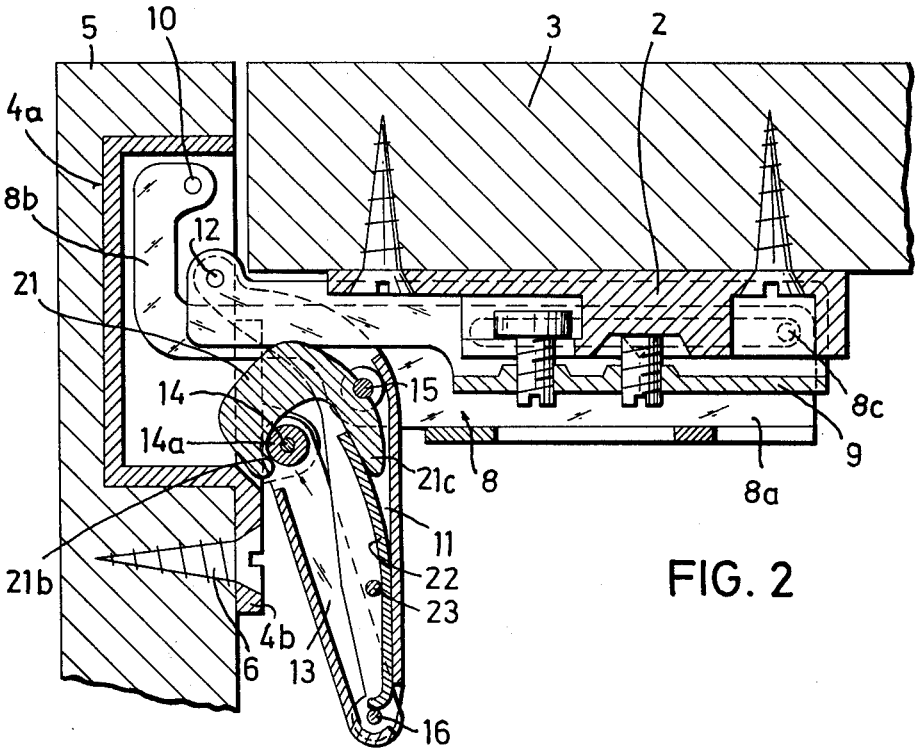
FIG. 2 is a cross-sectional view through the hinge of FIG. 1, and more clearly illustrates various components of the hinge including a spring carried by a hinge element biasing the latch in its locked position.
Figure 3:
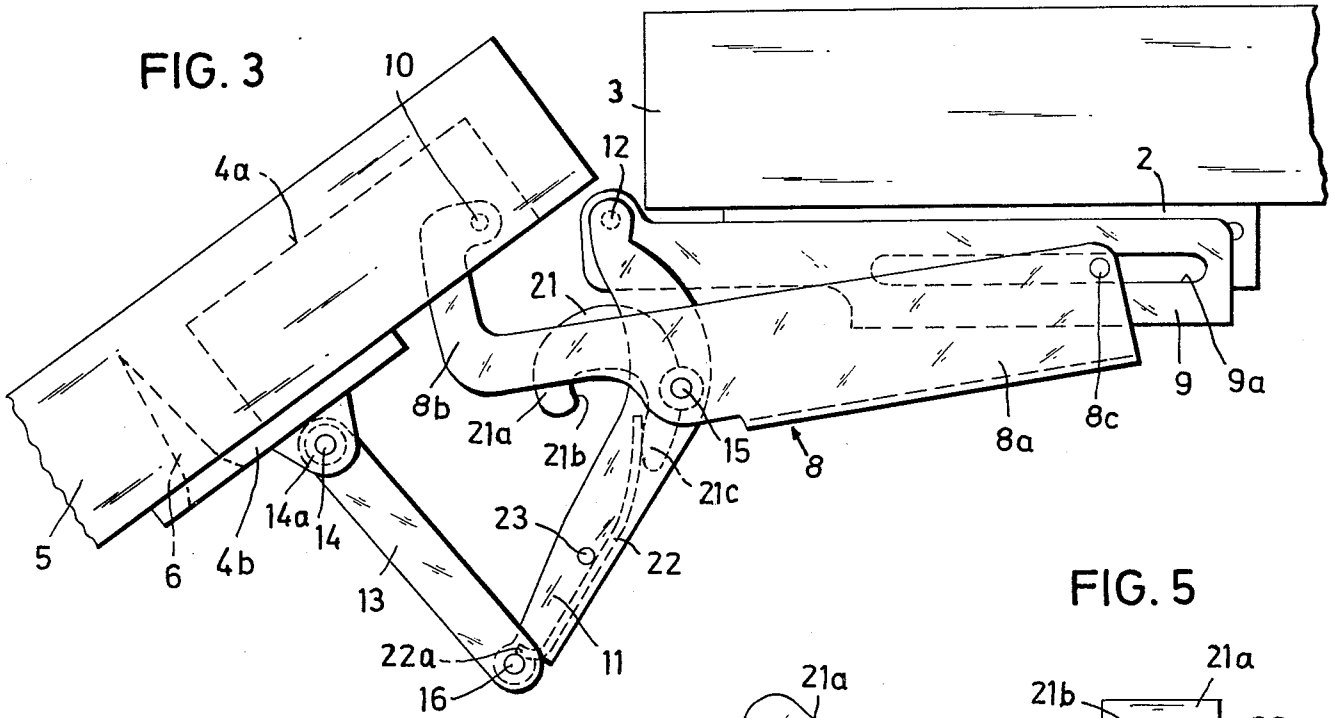
FIG. 3 is a fragmentary top plan view similar to FIG. 1, and illustrates the door partially opened relative to the frame.

A novel hinge constructed in accordance with this invention is best illustrated in FIGS. 1 through 3 of the drawings and is generally designated by the reference numeral 1. The hinge 1 includes a mounting plate 2 which is secured by screws (not shown) or the like to a frame or like piece of furniture 3 with which is associated a door or leaf 5 which is adapted to be moved between closed (FIG. 1) and opened (FIG. 3) positions. A mounting plate 4 is utilized to secure the hinge 1 to the door 5. The mounting plate 4 includes a cup-shaped portion 4*a* which is received in a cylindrical recess (unnumbered) of the door 5 and an integral plate 4*b* through which pass securing screws 6.

A first hinge element 9 is suitably secured to or formed as an integral part of the molding plate 2, and opposite faces thereof each include a longitudinal slot 9*a*, only one of which is illustrated in the drawings.

A second hinge element 8 includes opposite end portions 8*a*, 8*b*. The end portion 8*a* is of us generally U-shaped configuration as viewed in transverse cross-section and each leg (unnumbered) of the end portion 8*a* carries a pin 8*c* which projects into its associated slot 9*a*. Thus, the two pins 8*c* received in the two slots 9*a* permit the second hinge element 8 to be displaced in a sliding fashion in the manner readily apparent from a comparison of FIGS. 1 and 3. First pivot means 10 pivotally connects the end portion 8*b* of the second hinge element 8 to the mounting plate 4. The end portion 8*b* of the second hinge element 8 is actually a pair of spaced parallel arms corresponding to extensions of the sides (unnumbered) of the end portion 8*a*.

Figure 5:
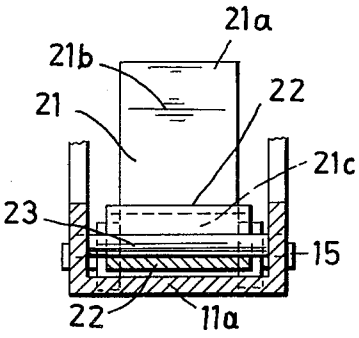
FIG. 5 is a fragmentary sectional view taken generally along line V—V of FIG. 4, and illustrates the manner in which a transverse pin spans legs of the generally U-shaped hinge element.
Figure 4:
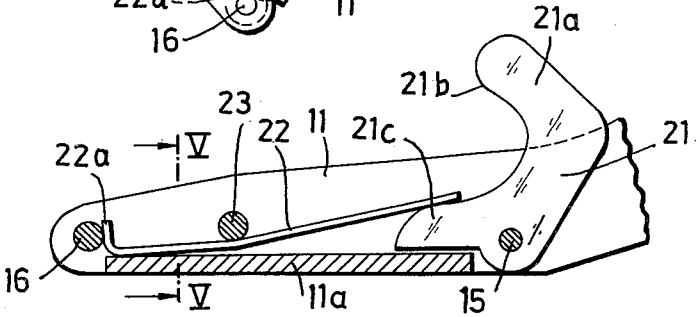
FIG. 4 is a fragmentary longitudinal sectional view through the hinge element carrying the latch, and illustrates the manner in which a spring is mounted for biasing the latch toward its latching or locked position.

A third hinge element 11 is also of a generally U-shaped configuration, and is best illustrated in FIG. 5, and includes a bright portion 11*a* and a pair of upstanding legs (unnumbered). The legs of one end portion of the link 11 are connected by a pivot 12 to an end portion of the first hinge element 9 remote from the longitudinal slots 9*a*.

A fourth hinge element 13 is connected by pivot means 14 to the plate 4*b* of the mounting plate 4 and is also pivotally connected by a pivot 16 to an end portion of the third hinge element 11. Another pivot 15 pivotally connects medial portions (unnumbered) of the second and third hinge elements 8 and 11, respectively. A sleeve or bushing 14*a* is rotatably carried by the pivot 14 with absolute minimum tolerance therebetween. Stated otherwise, tolerance between the bushing 14*a* and the pivot 14 is sufficient to permit rotation of the bushing but insufficient to permit excessive shifting motion to assure immobility of the door 5 relative to the frame in the closed position (FIG. 2).

Latch means, generally designed by the reference numeral 21 is of a generally C-shaped configuration and includes a terminal end portion 21*a* having a latching nose 21*b* and an opposite terminal end portion 21*c*. The latching means or latch 21 lies within the interior of the third hinge element 11, as is best illustrated in FIG. 5, and is pivotally connected thereto by means of the pivot 15. A leaf spring 22 constructed of resilient material includes one end portion (unnumbered) which overlies the terminal end portion 21*c* of the latch 21. An opposite end portion 22*a* of the spring 22 is bent and bears against the pivot 16. A medial portion (unnumbered) of the spring 22 is bridged by a transverse pin 23 connected to the legs (unnumbered) of the third hinge element 11 in the manner best illustrated in FIG. 5. As is clearly apparent from FIGS. 1 through 4, the spring 22 normally biases the latch 21 toward its latching position which in FIGS. 1 and 2 is in a counterclockwise direction.

The operation of the hinge 1 is believed apparent simply from a comparison of FIGS. 1 and 3. However, it is pointed out that in the closed position (FIG. 1) the spring 22 bearing against the terminal end portion 21*c* of the latch 21 assures that the nose 21*b* is in intimate locking contact with the bushing or sleeve 14*a* carried by the pivot 14. It is further to be noted that in the absence of the latch 21 and the spring 22, the hinge 1 will still function as a normal (not latching) hinge. Thus, the hinge 1 can be utilized two different ways simply by utilizing or not utilizing the latch 21 and the associated spring 22.

Figure 6:
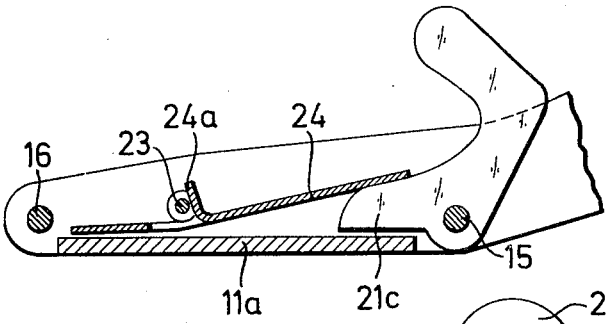
FIG. 6 is a view similar to FIG. 4, and illustrates a modified spring for biasing the latch toward its latched position.

Reference is now made to FIG. 6 of the drawings in which leaf spring 24 corresponding to the spring 22 is modified such that a tab 24*a* is struck therefrom and bent upwardly to bear against the transverse pin 23.

Figure 7:
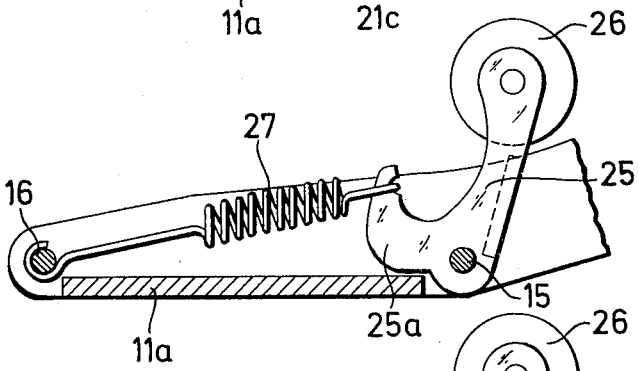
FIG. 7 is a view similar to FIG. 6, and illustrates a tension spring for biasing a latch carrying a roller toward its latched position.

In accordance with the embodiment of the invention illustrated in FIG. 7, latch means 25 carry a roller 26 and a terminal end portion 25*a* of the latch or latch means 25 and has secured thereto an end (unnumbered) of a tension spring 27 whose opposite end is connected to the pivot pin 16.

Figure 8:
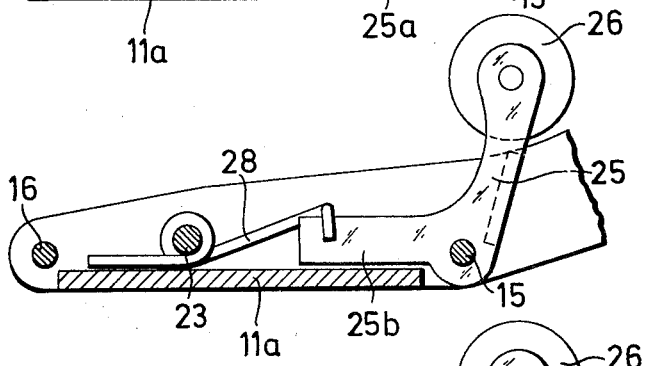
FIG. 8 is a view similar to FIG. 7, and illustrates another modification of the invention and the use of a torsion spring to bias the latch toward its latched position.

In accordance with the embodiment of the invention illustrated in FIG. 8 a torsion spring 28 is held in position by the transverse pin 23 passing through the coils (unnumbered) thereof and an arm (unnumbered) of the spring bears against a terminal end portion 25*b* of the latch 25 to urge the latter toward its latched position.

Figure 9:
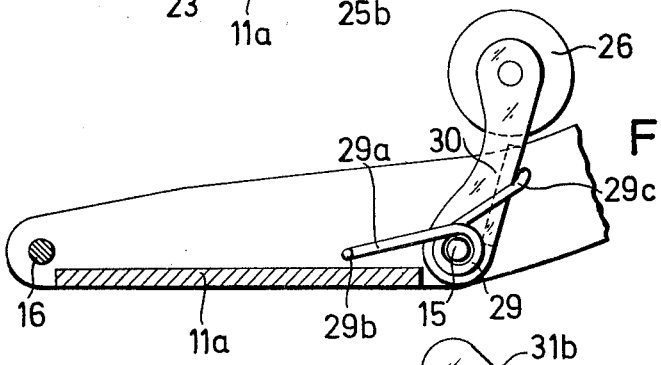
FIG. 9 is a view similar to FIG. 8, and illustrate the latch as a leg spring biased toward its latched position.

In accordance with the embodiment of the invention illustrated in FIG. 9 the latch 30 is biased toward its latching position by a helical spring 29 having a leg 29*a* and an end 29*b* received in an aperture (unnumbered) of one of the legs (unnumbered) of the third hinges element 11. An opposite end portion 29*c* of the spring 29 is bent about the latch 30 and due to the tension of the spring 29, the latch 30 is biased in a counterclockwise direction as viewed in this figure.

Figure 10:
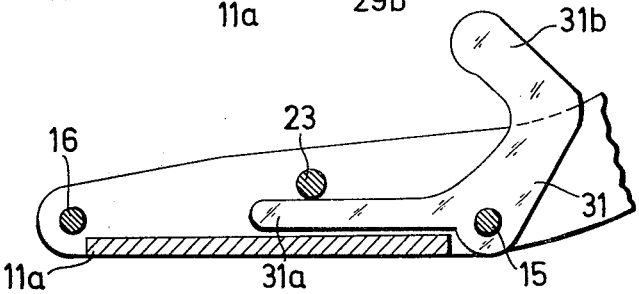
FIG. 10 is a view similar to FIG. 9, and illustrates a latch having a resilient leg which inherently provides biasing force for urging the latch toward its latched position.

In accordance with the embodiment of the invention illustrated in FIG. 10, a latch 31 includes a terminal end portion 31*b* for latching upon the bushing 14*a* and an opposite end portion 31*a* underlying the transverse pin 23. In this case, the end portion 31*a* or the entire latch 31 is constructed from resilient material and thus the biasing force in the latched position is inherently achieved through the resilient nature of the material from which the latch 31 is constructed. Preferably the entire latch 31 is constructed from suitable elastic synthetic plastic material (polymeric or copolymeric material) consisting of polyuretheyene or the like.

Thus, in accordance with this invention, the latch means 21, 25, 30 and 31 is at all times mounted on the pivot pin 15 for producing a concealed latch of a simple design along with smooth snap action and a good closing force.

While preferred forms and arrangement of parts have been shown in illustrating the invention, it is to be clearly understood that various changes in details and arrangements of parts may be made without departing from the scope and spirit of this disclosure.

We claim:

1. A hinge comprising a first element adapted to be secured to one of a pair of relatively movable bodies, a second element having opposite end portions, first pivot means pivotally mounting a first of said second element end portions to the other of said pair of relatively movable bodies, means slidably coupling a second end portion of said second element relative to said first element, a third element, said third element having opposite end portions and a medial portion therebetween, second pivot means pivotally mounting a first of said third element end portions to said first element, third pivot means pivotally mounting said third element medial portion to said second element between the first and second end portions of the latter, latch means pivotally connected to said third element by said third pivot means, and said latch means including a free terminal end portion for snap engagement with a portion of said other body in a closed position of said bodies.

2. The hinge as defined in claim 1 including a fourth element having opposite end portions, and fourth and fifth pivot means connecting first and second end portions of said fourth element to said third element second end portion and said other body respectively.

3. The hinge as defined in claim 2 wherein said portion of said other body is said fifth pivot means.

4. The hinge as defined in claim 3 wherein said latch means is of a generally C-shaped cross-sectional configuration.

5. The hinge as defined in claim 3 wherein said latch means is of a generally C-shaped cross-sectional configuration, and said fifth pivot means includes freely rotatable bushing means snap engaged by said free terminal end portion.

6. The hinge as defined in claim 3 including spring means carried by said third element for spring biasing said latch means toward its latched position.

7. The hinge as defined in claim 3 wherein said latch means is of a generally C-shaped cross-sectional configuration, said latch means includes another free terminal end portion, at least said another free terminal end portion being constructed of resilient material and means precluding pivotal movement of said another free terminal end portion whereby the latter bends during a latching operation to inherently bias said first-mentioned free terminal end portion into snap engagement with said fifth pivot means.

8. The hinge as defined in claim 3 wherein said third element is of a U-shaped configuration as viewed in transverse cross-section defined by a bight portion and a pair of legs, and said latch means is disposed between said legs.

9. The hinge as defined in claim 3 including a roller carried by said free terminal end portion, and torsion spring means for biasing said free terminal end portion to its latched position.

10. The hinge as defined in claim 4 wherein said C-shaped latch means includes another free terminal end portion, and spring means biasing said another free terminal end portion in a direction to move said first-mentioned terminal end portion to its latched position.

11. The hinge as defined in claim 4 wherein said C-shaped latch means includes another free terminal end portion, and leaf spring means biasing said another free terminal end portion in a direction to move said first-mentioned terminal end portion to its latched position.

12. The hinge as defined in claim 4 wherein said C-shaped means includes another free terminal end portion, and tension spring means biasing said another free terminal end portion in a direction to move said first-mentioned terminal end portion to its latched position.

13. The hinge as defined in claim 4 wherein said C-shaped latch means includes another free terminal end portion, and torsion spring means biasing said another free terminal end portion in a direction to move said first-mentioned terminal end portion to its latched position.

14. The hinge as defined in claim 4 wherein said third element is of a U-sahped configuration as viewed in transverse cross-section defined by a bight portion and a pair of legs, and said latch means is disposed between said legs.

15. The hinge as defined in claim 5 wherein said third element is of a U-shaped configuration as viewed in transverse cross-section defined by a bight portion and a pair of legs, and said latch means is disposed between said legs.

16. The hinge as defined in claim 6 wherein said third element is of a U-shaped configuration as viewed in transverse cross-section defined by a bight portion and a pair of legs, and said latch means is disposed between said legs.

17. The hinge as defined in claim 7 wherein said third element is of a U-shaped configuration as viewed in transverse cross-section defined by a bight portion and a pair of legs, and said latch means is disposed between said legs.

18. The hinge as defined in claim 9 wherein said third element is of a U-shaped configuration as viewed in transverse cross-section defined by a bight portion and a pair of legs, and said latch means is disposed between said legs.

19. The hinge as defined in claim 10 wherein said third element is of a U-shaped configuration as viewed in transverse cross-section defined by a bight portion and a pair of legs, and said latch means is disposed between said legs.

* * * * *